US007340189B2

(12) United States Patent
Itagaki et al.

(10) Patent No.: US 7,340,189 B2
(45) Date of Patent: Mar. 4, 2008

(54) IMAGE FORMING APPARATUS AND IMAGE ADJUSTING METHOD

(75) Inventors: Seiko Itagaki, Hachioji (JP); Hiroshi Akita, Hachioji (JP); Isamu Miura, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 235 days.

(21) Appl. No.: 11/303,542

(22) Filed: Dec. 16, 2005

(65) Prior Publication Data

US 2006/0198644 A1 Sep. 7, 2006

(30) Foreign Application Priority Data

Mar. 1, 2005 (JP) ..... 2005-055588

(51) Int. Cl.
*G03G 15/08* (2006.01)
*G03G 15/00* (2006.01)

(52) U.S. Cl. ..... 399/29; 399/49; 399/257

(58) Field of Classification Search ..... 399/27, 399/29, 49, 72, 257
See application file for complete search history.

(56) References Cited

U.S. PATENT DOCUMENTS 5,842,089 A * 11/1998 Kunihiro et al.
6,324,354 B1 * 11/2001 Tode et al.
6,744,995 B2 * 6/2004 Fukuyama et al. ..... 399/49
6,775,487 B2 * 8/2004 Kakeshita ..... 399/27
6,892,034 B2 * 5/2005 Katayanagi et al. ..... 399/49
7,085,506 B2 * 8/2006 Forbes et al. ..... 399/257
7,095,966 B2 * 8/2006 Adachi ..... 399/257
2004/0170441 A1 * 9/2004 Forbes et al. ..... 399/257
2005/0286917 A1 * 12/2005 Martin et al. ..... 399/27

FOREIGN PATENT DOCUMENTS

JP 2004-125829 A 4/2004

* cited by examiner

*Primary Examiner*—Susan Lee
(74) *Attorney, Agent, or Firm*—Frishauf, Holtz, Goodman & Chick, P.C.

(57) ABSTRACT

An image forming apparatus includes: an image carrying member; a latent image forming unit to form an electrostatic latent image on the image carrying member; a developing unit to develop the electrostatic latent image on the image carrying member to form a toner image; a forcible discharge unit to forcibly discharge the toner from the developing unit; a toner supplying unit to supply toner by the discharged quantity; and a fog-detection unit to detect fog of the image, wherein the forcible discharge unit forcibly discharges the toner from the developing unit based on a detected result of the fog-detection unit.

20 Claims, 4 Drawing Sheets

IMAGE FORMING APPARATUS AND IMAGE ADJUSTING METHOD

BACKGROUND OF THE INVENTION

1. Field of the Invention

The present invention relates to an image forming apparatus and an image adjusting method, based on an electrophotographic system. In particular, the invention relates to an image forming apparatus and an image adjusting method, capable of preventing degradation of image quality due to deterioration of toner properties by forcibly discharging the toner from a developing unit.

2. Description of Related Art

In an image forming apparatus using an electrophotographic system, there has been developed such technology that forms high quality images superior in image characteristics such as resolution, reproducibility of precise images, and makes it possible to form high quality images close to those printed by plate-using printing. As the print quality has become higher, a problem arises in degrading image quality due to deterioration of toner properties, and therefore measures for this problem have been studied.

It has been clarified that the toner deterioration occurs mainly when the toner remains in a developing unit for a long time, and the toner is stirred and carried in the developing unit to receive stress for a long time.

As a solution for this toner deterioration, such a technique has been developed that the toner in a developing unit is forcibly discharged and a new toner is supplied to exchange the toner (refer to patent Document 1: JP 2004-125829A). In this patent document, the number of rotation of a developing roller and the number of image dots are counted and stored, and if the number of image dots at a given number of rotation is less than a predetermined threshold value, then the toner is discharged from the developing unit.

According to the technique disclosed in patent Document 1, it has been found that degradation of image quality is somewhat prevented, but the image quality is not improved enough. Particularly, it has been found to be difficult to prevent degradation of image quality by prior art including the technique disclosed in patent Document 1, when images are formed at near life-time of developer, or under an environment of high temperature and high humidity. That is, according to the technique of Patent Document 1, it is difficult to keep track of the state of developer with high accuracy because of a control with prospects using the number of image dots.

SUMMARY OF THE INVENTION

In accordance with a first aspect of the invention, the image forming apparatus comprises:

an image carrying member;

a latent image forming unit to form an electrostatic latent image on the image carrying member;

a developing unit to develop the electrostatic latent image on the image carrying member to form a toner image;

a forcible discharge unit to forcibly discharge the toner from the developing unit;

a toner supplying unit to supply toner by the discharged quantity; and a fog-detection unit to detect fog of the image, wherein the forcible discharge unit forcibly discharges the toner from the developing unit based on a detected result of the fog-detection unit.

In accordance with a second aspect of the invention, the image adjusting method comprises:

adjusting a developing bias voltage applied on the image carrying member;

developing an image on the image carrying member by toner in a developing unit, to form a toner image;

detecting fog by using the toner image;

discharging the toner forcibly from the developing unit based on a result of fog detection; and supplying toner after the discharging the toner forcibly.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

DETAILED DESCRIPTION OF THE PREFERRED EMBODIMENTS

Figure 1:
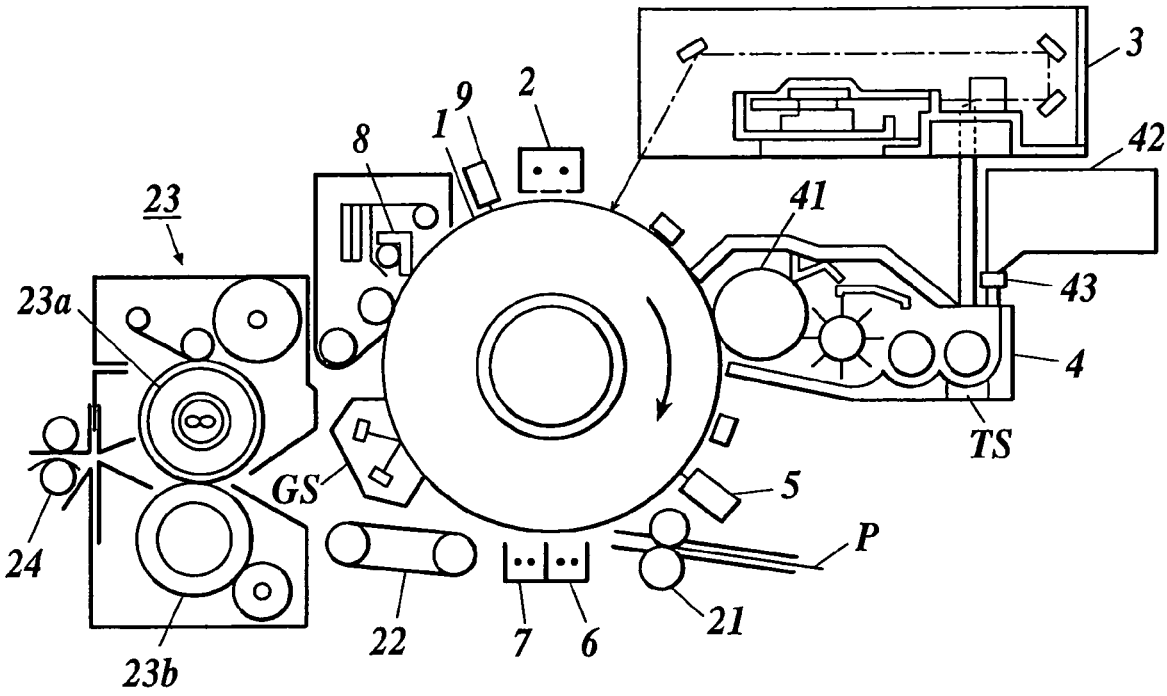
FIG. 1 is a view showing an entire image forming apparatus according to a first embodiment of the present invention.

The invention will be explained below according to the embodiments shown in the drawings, however the invention is not limited to the embodiments shown in the drawings.

Embodiment 1

<Image Forming Apparatus>

FIG. 1 is a view showing an entire image forming apparatus according to a first embodiment of the invention.

A photoreceptor 1 is a drum-shaped one serving as an image carrying member in which phthalocyanine pigment compound dispersed in polycarbonate is coated on a metal-made cylindrical substrate as an organic semiconductor layer to be negatively charged. The photoreceptor has a film thickness of the photosensitive layer including a charge transport layer of 30 μm, a drum diameter of 80 mm, and is driven to rotate in a direction indicated by an arrow at a peripheral speed (vp) of 280 mm/s.

A charging device 2 is one using a scorotron charging device, which uniformly charges the periphery of the rotating photoreceptor 1 to a predetermined polarity and potential.

An exposing device 3 is one adopting a laser scanning system in which a semiconductor laser (LD) is used, the LD having a wavelength of 700 nm and an output power of 300 μW. The exposing device 3 emits a laser beam to scan and expose the uniformly charged surface of the photoreceptor 1 and form an electrostatic latent image. The charging device 2 and the exposing device 3 constitute a latent image forming unit for forming an electrostatic latent image on the photoreceptor 1.

A developing device 4 develops the electrostatic latent image on the photoreceptor 1 with a rotating developer carrying member 41 facing the photoreceptor 1, as a developing unit. With a contact or non-contact developing method using a two-component developer including a toner and a carrier, a toner image is formed by reversal development. The developer carrying member 41 is so constructed that the periphery of a magnet roll is covered with an aluminum-made sleeve with application of stainless thermal-spraying surface treatment. The developer carrying member 41 has a roller diameter of 40 mm, rotates at a peripheral speed (vs) of 560 mm/s, so that a peripheral speed ratio to the photoreceptor 1 (vs/vp) is set to 2. A developing bias voltage is applied to the developer carrying member 41, a direct-current component being applied from a power source Edc (shown in FIG. 3), and an alternate-current component from a power source Eac (shown in FIG. 3).

As a developer, a two-component developer including a toner and a carrier as main components is used. It is preferable as the toner to use a polymerized toner having a volume-average particle diameter of 3-6.5 μm. Use of the polymerized toner allows an image forming apparatus to form images with high resolution, stable toner density and very rare occurrence of toner fogging.

The polymerized toner is manufactured by the following process.

A toner binder resin is produced and a toner shape is formed and obtained by polymerization of a material monomer or pre-polymer for the binder resin and a subsequent chemical treatment. More specifically, they are obtained by a polymerization reaction, such as suspension polymerization or emulsion polymerization, and if needed, a fusion step between particles. The polymerized toner is manufactured by polymerizing the material monomer or pre-polymer after uniformly dispersing it in a water-based solution, so that a spherical toner can be obtained with uniform particle size distribution and shape.

It is preferable that a shape factor SF-1, which indicates the spherical degree of the toner, falls within 100-140, and a shape factor SF-2, which indicates the degree of irregularity of the toner, within 100-120. Here, the shape factor SF-1 and SF-2 are defined by the following expressions, respectively.

$$SF\text{-}1=(L\max^2/A)\times(\pi/4)\times 100$$

$$SF\text{-}2=(L\text{around}^2/A)\times(1/4\pi)\times 100$$

where Lmax is the maximum diameter, Laround is the circumference length, and A is the toner projected area.

As the volume-average particle diameter of the toner decreases below 3 μm, photographic fog and toner scattering tend to occur. The upper limit 6.5 μm is the upper limit of particle diameters that can achieve forming a high-quality image that is an object of the embodiment.

As the carrier, a ferrite-cored carrier, formed from magnetic particles with a volume-average particle diameter of 25-65 μm and a magnetization quantity of 20-70 emu/g, is preferably used. A carrier with a particle diameter of less than 25 μm tends to cause carrier adhesion. With the use of a carrier having a particle diameter exceeding 65 μm, uniform density of images sometimes may not be formed.

A pre-transfer exposure light source 5 is a pre-transfer exposure light source for irradiating the toner image to heighten its transfer performance. The light source is an LED having a light wavelength of 700 nm, and irradiates at a light output of 10 lux.

A transfer device 6 is a transfer device using a corotron charging device. The distance between a wire and the photoreceptor 1 is 8 mm, and the distance between the wire and a back plate is 12 mm. The device 6 transfers the toner image on the photoreceptor 1 onto a recording medium by constant current control with a transfer current (Itr) of 200 μA.

A separation device 7 is a separation device using a corotron charging device. The distance between the wire and the photoreceptor 1 is 8 mm, and the distance between the wire and the back plate is 12 mm. The device 7 facilitates separation of the recording medium from the photoreceptor 1 by separation current with an AC component of 100 μA and a DC component of −200 μA.

The recording medium P fed from a paper feed part is fed by registration rollers 21 in synchronism with the toner image formed on the photoreceptor 1, and the toner image is transferred onto it at a transfer nip portion by the transfer device 6. The recording medium P passing through the transfer nip portion is separated from the surface of the photoreceptor 1 by the separation device 7, and conveyed to a fixing device 23 by a conveyance belt 22.

The fixing device 23 includes a heating roller 23*a* having a heater arranged therein, and a pressing roller 23*b*. The recording medium P bearing the toner image is heated and pressurized between the heating roller 23*a* and the pressing roller 23*b*, so that the toner image is fixed. The recording medium on which the toner image is fixed is ejected onto an ejection tray outside the apparatus by ejection rollers 24.

The surface of the photoreceptor 1, after the transfer of toner image to the recording medium P, is cleaned by a cleaning device 8 to remove un-transferred remaining toner. In the embodiment, a blade made of urethane rubber which is provided in the cleaning device 8 is used as a cleaning unit. The cleaning blade is of a counter type which comes into slidable contact with the outer surface of the photoreceptor 1 to clean it. The outer surface of the photoreceptor 1, which has been cleaned while passing through the cleaning device 8, is irradiated by a pre-charging exposing (PCL) device 9 using a light source having a light wavelength of 700 nm and a light output of 10 lux, so that the residual potential is decreased. Then, the process proceeds to a next image forming cycle.

A toner density sensor TS is a toner density sensor for detecting the toner density of the developer in the developing unit 4. The sensor TS detects the density of toner in the developer by measuring the magnetic permeability of the developer. A toner hopper 42 is one for storing the toner, and a toner supplying device 43 as the toner supplying unit is one for supplying a toner from the toner hopper to the developing unit 4 on the basis of the detection result of the toner density sensor TS or the like.

<Image Quality Adjustment>

A controller CR (shown in FIG. 3) executes an image forming step for forming an images on the recording medium. The controller CR also executes an image quality adjustment step (image quality adjustment mode) which includes setting an image forming condition for occurrence of fog, detecting fog of the image, controlling forcible discharge of toner based on the detected result and exchange of toner, which will be explained below. The controller CR executes the image quality adjustment step at every predetermined number of sheets of image formation, at every image formation job, or the like, when the apparatus is turned on by a main switch.

The image forming apparatus shown in FIG. 1 is provided with a fog-detection unit to detect fog of the image. The fog-detection unit according to the embodiment includes an image density sensor GS for detecting the density of an image.

The image density sensor GS detects fog on the surface of the photoreceptor 1 by measuring reflectance on the surface of the photoreceptor 1.

Fog is a known phenomenon that the toner adheres to a non-image area, and the fog is detected by a change in the reflectance on the surface of the photoreceptor in a state that the toner adheres to the surface of the photoreceptor 1.

Figure 2:
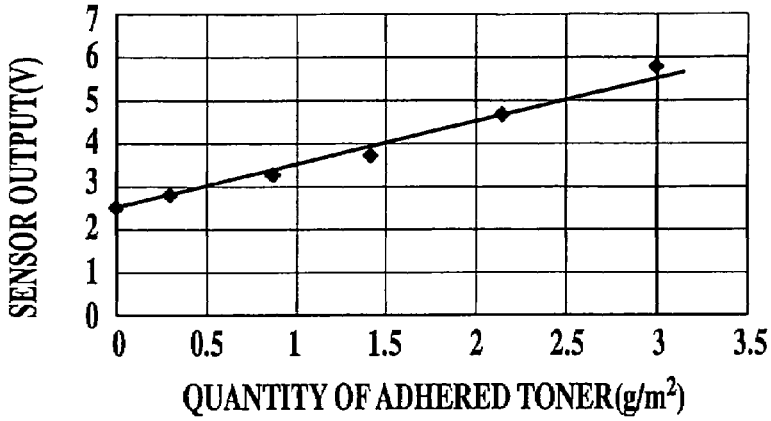
FIG. 2 is a graph showing a relationship between outputs of an image density sensor and image density (toner adhesion amount)

FIG. 2 shows the change of output of the image density sensor GS versus the quantity of adhered toner forming fog.

As shown in the diagram, the sensor output increases nearly linear as the quantity of adhered toner increases. Therefore, the fog can be quantitatively detected by detecting the output of the image density sensor GS.

Figure 3:
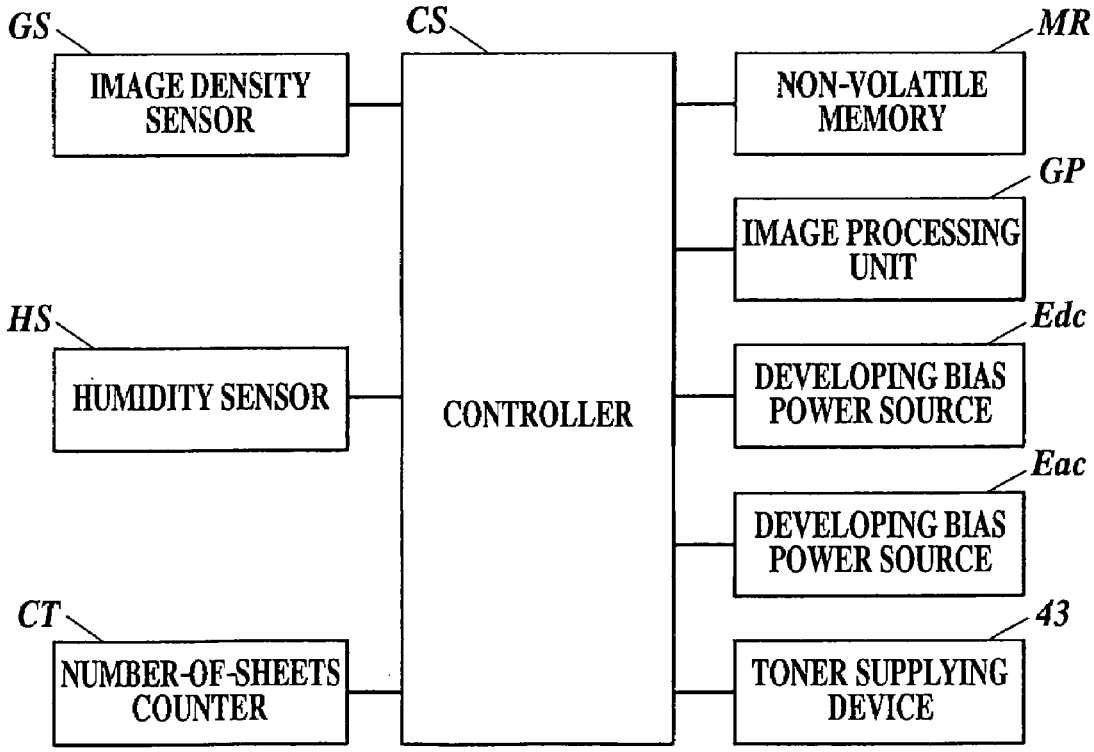
FIG. 3 is a block diagram of a control system in the image forming apparatus according to Embodiment 1 of the invention.

FIG. 3 is a block diagram of a control system for executing the image quality adjustment step that includes fog detection, forcible toner discharge based on the fog detection, and toner replenishment for replenishing toner by the discharged amount.

In a fog detection step in an image quality adjustment step, the controller CR sets a fog margin narrower for easier occurrence of photographic fog by the power source Edc applying the DC component of developing bias to the developer carrying member 41 shown in FIG. 1, and operates the charging device 2 and the developing unit 4 with the photoreceptor 1 rotatably driven. In the fog detection step, exposure by the exposing device 3 is not performed.

The fog margin will be explained referring to FIG. 4.

Figure 4:
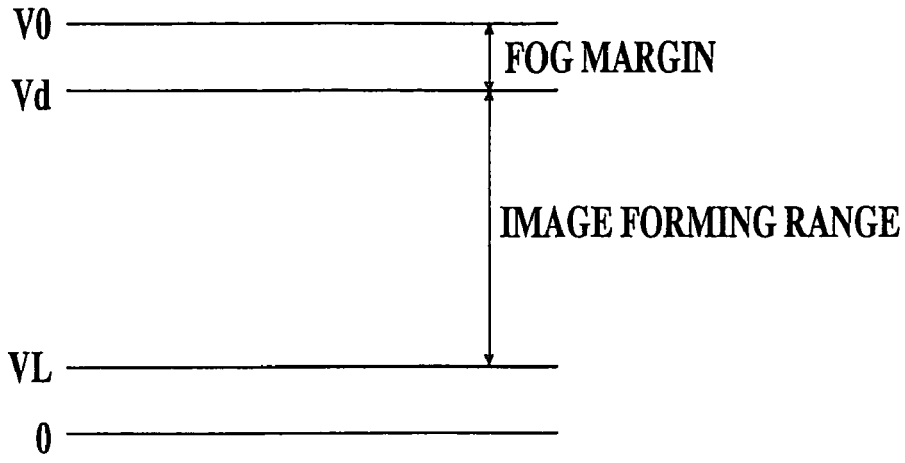
FIG. 4 is a diagram showing potentials of a patch image detected by a potential sensor.

FIG. 4 shows surface potentials of the photoreceptor 1. In the diagram, V0 indicates a charged potential of the photoreceptor 1, which is the surface potential of the photoreceptor 1 charged by the charging device 2 and not exposed, Vd a potential of the DC component of developing bias, which is output of the power source Edc in FIG. 3, and VL a maximum exposure portion potential, which is the surface potential of the photoreceptor 1 charged by the charging device 2 and received maximum intensity of exposure by the exposing device 3.

At the time of development, the toner adheres to portions having a potential within an image forming range of Vd-VL to form an image. A range V0-Vd is a potential area where the toner does not adhere, and called a fog margin.

The toner does not adhere, theoretically, to the portions having a potential within the fog margin range, but when a force other than an electrostatic force acts or reversal-charged toner exists, the toner adheres to portions having a potential within the fog margin range on the photoreceptor 1 to thereby form the fog.

As the fog margin V0-Vd becomes narrower, the fog tends to occur, and as the fog margin V0-Vd becomes wider, fog is harder to occur.

In the image forming step for forming a recording image, the fog margin V0-Vd is set relatively wider to form an image, while, in the fog detection step, the photoreceptor 1 passes through the developing unit 4 with the fog margin V0-Vd set narrower than in the image forming step to be in a condition of easier fog occurrence.

As a result, fog is formed on the photoreceptor 1, and, while the photoreceptor 1 passes through the image density sensor GS, fog density is detected by the image density sensor GS acting as a fog-detection unit.

Following the fog detection step described above, the controller CR then executes a toner forcible-discharge step.

The controller CR serving as a forcible-discharge unit controls an image processing unit GP based on the fog-detection output from the image density sensor GS so that the controller CR causes the image processing unit GP to output image data for forming a forcible-discharge image and drives the exposing device 3 to form on the photoreceptor 1 an electrostatic latent image for forcible discharge.

The electrostatic latent image is developed in the developing unit 4 to forcibly discharge the toner from the developing unit 4. The quantity of toner discharged from the developing unit 4 is determined according to the output from the image density sensor GS that has detected the fog, that is, an area of the forcible-discharge image is set according to the output from the image density sensor GS. Here, the forcible-discharge image is formed on positions except the recording image area, such as a position between recording images or a position outside a recording image in a width direction.

Table 1 shows an area of a forcible-discharge image versus an output from the image density sensor GS.

TABLE 1

| Sensor Output | Area of Forcible Discharge Image |
|---|---|
| $V0 < 2.75$ | 0% |
| $2.75 \leqq V0 < 3$ | 1% |
| $3 \leqq V0 < 3.25$ | 2% |
| $3.25 \leqq V0 < 3.5$ | 3% |
| $3.5 \leqq V0$ | 3.50% |

In Table 1, the area of a forcible-discharge image is represented by percentage of the area of the forcible-discharge image to the area of one image sheet including a ground portion of the sheet. The output from the image density sensor GS, as shown in FIG. 2, varies according to fog levels. Therefore, by forcibly discharging the toner with formation of an image having the area shown in table 1, the amount of toner corresponding to the fog level can be discharged from the developing unit 4. The correlation between the output from the image density sensor GS and the area of a forcible-discharge image, which is shown in table 1, is stored in a non-volatile memory MR.

As to the forcible discharge, instead of forcibly discharged toner quantity by changing the area of a forcible-discharge image, forcibly discharged quantity may be changed by changing image density. For instance, forcibly discharged toner quantity can be changed by changing the density of a forcible-discharge image, such as by changing a pixel value of image data generated by the image processing unit, by changing the developing bias voltage, or by changing a moving speed ratio of the photoreceptor 1 to the developer carrying member 41.

After the forcible discharge, the controller CR operates the toner supplying unit 43 to replenish the toner by the discharged quantity to the developing unit 4. This toner replenishing is carried out by ordinary toner supply control. That is, the toner density sensor TS detects the toner density of the developer in the developing unit 4, and the toner is supplied until the toner density reaches a predetermined value, thus the toner is replenished by the discharged quantity.

In addition to the forcible discharge and forcible replenishing of toner corresponding to the toner charge quantity described above, toner density control shown in FIG. 5 is executed by the controller CR as a density control unit, in the embodiment.

Figure 5:
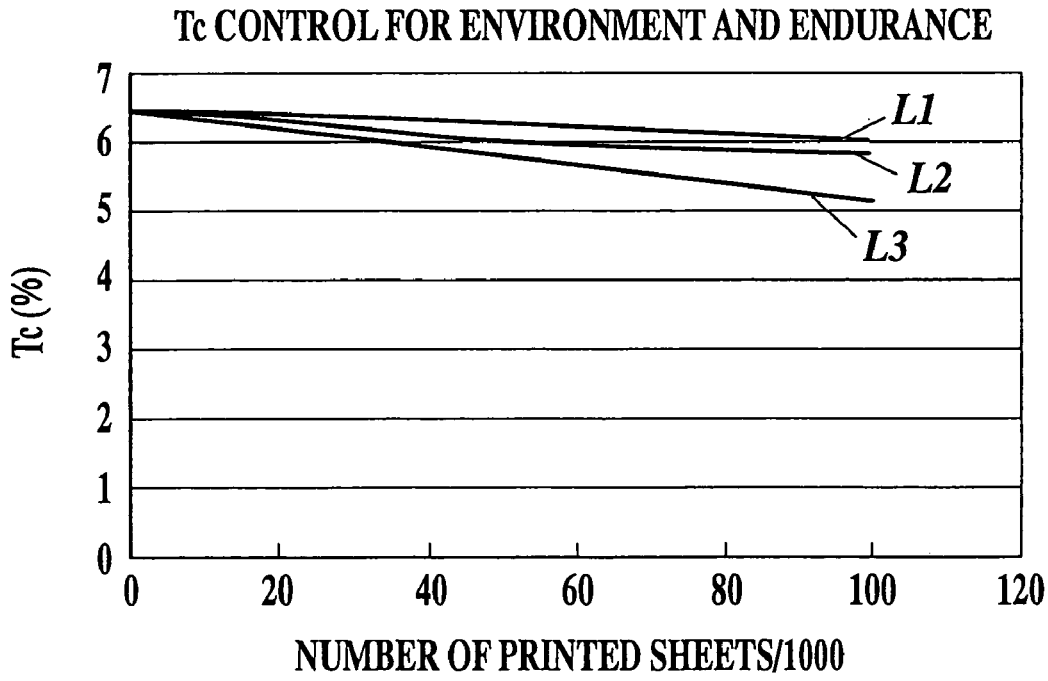
FIG. 5 is a graph showing an example of toner density control depending on the environment and the number of printed sheets.

FIG. 5 shows an example of toner density control according to the environment and the number of printed sheets.

In FIG. 5, the ordinate represents toner density in the developer (weight percent), and the abscissa the number of printed sheets. Curves L1, L2 and L3, respectively, indicate the toner density, namely, control values of toner density for obtaining suitable image quality. L1 shows a suitable density curve under low humidity environment of less than 30% in relative humidity, L2 a suitable density curve under normal humidity environment of not less than 30% and less than 55%, and L3 a suitable density curve under high humidity environment of 55% or more.

The graph clearly shows that, as the number of printed sheets increases, the control value of toner density decreases, and the higher humidity causes the control value of toner density to be decreased.

The controller CR serving as the density control unit executes the toner density control as shown in FIG. 5 according to the detected humidity from a humidity sensor HS detecting environmental humidity and a number-of-sheets counted value from a number of printed-sheets counter CT.

With this control, higher quality of images can be stably formed.

As described above, in Embodiment 1, the image density sensor GS as the fog-detection unit detects fog, and the controller CR as the density control unit controls forcible discharge of toner based on the detected result. Accordingly, the image forming apparatus securely detects the increase of deteriorated toner and exchanges the deteriorated toner, so that it can prevent the occurrence of photographic fog due to the deteriorated toner securely and sufficiently, thus there can be realized an image forming apparatus capable of forming high quality images constantly. Further, the apparatus can prevent not only fogging but also roughness at half-tone area and toner scattering, and thus can form high quality images superior in overall image quality characteristics, without being affected by the environment at which image formation is conducted and by the apparatus usage condition.

In Embodiment 1, the apparatus detects fog when processed (an image quality adjustment mode) under the condition of fog occurrence according to the controller CR as the condition control unit, so that it can securely detect the state of easier fog occurrence even if fogging does not occur under ordinary image forming conditions, thus it can more securely prevent degradation of image quality due to fog occurrence, roughness at half-tone area, or the like.

In Embodiment 1, because an amount of toner corresponding to a fog level is discharged from the developing unit 4, control for preventing degradation of image quality is performed more precisely, so that stable formation of higher quality of images can be maintained.

In Embodiment 1, because the controller CR serving as the density control unit executes the toner density control according to the environment and the number of image-formed sheets, it is possible to realize an image forming apparatus capable of forming high quality images without being affected by change of environments and history of image formation.

Second Embodiment

Figure 6:
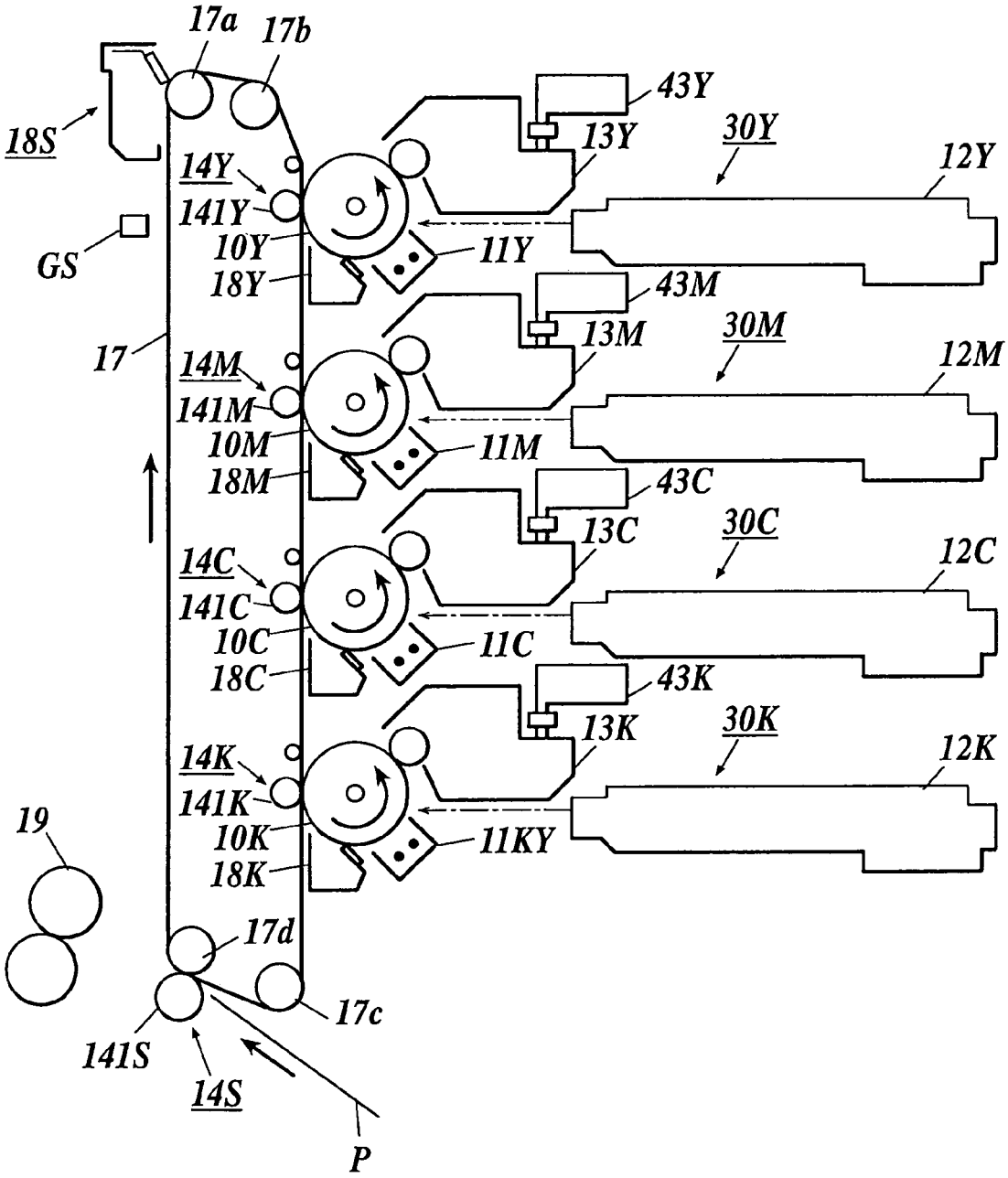
FIG. 6 is a view showing an entire color image forming apparatus according to Embodiment 2 of the present invention.

FIG. 6 shows an entire color image forming apparatus according to a second embodiment of the present invention.

This color image forming apparatus is of a so-called intermediate transfer type. The apparatus has a plurality of image carrying members on which different colors of toner images are formed, respectively. These toner images are primarily transferred sequentially on an intermediate transfer member acting as a transfer member, these single color toner images being superimposed on the intermediate transfer member. The color toner image formed on the intermediate transfer member is then secondarily transferred on a recording medium at once to form a color toner image on the recording medium.

This color image forming apparatus has an intermediate transfer member 17 consisting of an endless belt and circularly moving in an arrowed direction in FIG. 6, and four toner image forming units 30Y, 30M, 30C and 30K, respective units forming yellow, magenta, cyan and black toner images, and sequentially arranged apart from each other along the moving direction of the transfer member 17 in a toner image forming unit arrangement area located at the outer periphery of the transfer member 17. The intermediate transfer member 17 is looped about a roller group consisting of intermediate rollers 17*a*, 17*b* and 17*c* and a back-up roller 17*d*, which will be explained later, so as to be in oppositely contact with photoreceptors 10Y, 10M, 10C and 10K pressed by primary transfer unit 14Y, 14M, 14C and 14K in respective toner image forming units 30Y, 30M, 30C and 30K, while circularly moving.

The intermediate transfer member 17 is structured by, for example, a semi-conductive endless belt having a surface resistivity of $1\times10^{4}$-$1\times10^{12}$ $\Omega/cm^2$. The surface resistivity is measured by a resistance measurement instrument "HYRESTER-IP" (manufactured by YUKA ELECTRONICS) under the environment of normal temperature and humidity (20±1 degree C., 50±2% in humidity), being applied a voltage 100 V for 10 seconds.

The intermediate transfer member 17 is preferably formed of, for example, polyimide, such as thermosetting polyimide and modified polyimide.

The toner image forming unit 30Y associated with yellow toner images has a rotating drum-shaped photoreceptor 10Y consisting of a photosensitive body, and is provided, in the outer circumferential surface area of the photoreceptor 10Y, with a charging device 11Y, an exposing device 12Y, and a developing device 13Y serving as the developing unit, for developing with a developer relating to yellow toner images arranged in this order in a rotating direction of the photoreceptor 10Y. At a downstream position of the primary transfer unit 14Y which is provided at a downstream position of the developing unit 13Y in the rotating direction of the photoreceptor 10Y, there is provided a photoreceptor cleaning unit 18Y having a photoreceptor cleaning blade.

The photoreceptor 10Y includes a photosensitive layer composed of, for example, a resin containing an organic semiconductor that is applied to the outer circumferential surface of a drum-shaped metal substrate, and is arranged extending in a direction perpendicular to the paper surface in FIG. 6.

The charging device 11Y employs, for example, a scorotron charging device having a grid electrode and a discharge electrode. The exposing device 12Y employs, for example, a laser irradiating device.

The charging device 11Y and the exposing device 12Y constitute a latent image forming unit for forming an electrostatic latent image on the photoreceptor 10Y.

The developing unit 13Y includes a developing sleeve having a magnet provided inside the sleeve to hold a developer and rotating, and a voltage applying unit (not shown) for applying DC and/or AC bias voltage between the photoreceptor 10Y and the developing sleeve.

The primary transfer unit 14Y employs a so-called contact transfer method and includes a primary transfer roller 141Y arranged for forming a primary transfer region by pressing against the surface of the photoreceptor 10Y through the intermediate transfer member 17, and a transfer current supplying device (not shown) having, for example, a constant current power source to be connected to the primary transfer roller 141Y. The transfer current supplying device supplies a primary transfer current to the primary transfer roller 141Y to transfer the yellow toner image on the photoreceptor 10Y onto the intermediate transfer member 17.

The photoreceptor cleaning blade of the photoreceptor cleaning unit 18Y is made of, for example, elastic material such as urethane rubber. Its proximal end is supported by a supporting member and its distal end abuts against the surface of the photoreceptor 10Y. A direction extending from the proximal end of the cleaning blade is so-called a counter direction, that is, a reverse direction to the rotating move direction of the photoreceptor 10Y at the abutting position.

Other toner image forming units 30M, 30C and 30K have the same structure as of the yellow toner image forming units 30Y except that the developers contain magenta, cyan and black toners, respectively, instead of the yellow toner.

In primary transfer unit 14M, 14C and 14K of the toner image forming units 30M, 30C and 30K, the same amount of primary transfer current is applied to them as that in the primary transfer unit 14Y for the yellow toner image.

There is provided a secondary transfer unit 14S at a downstream side position of the toner image forming unit 30K for the black toner image, the unit 30K locating at the most downstream side position in the moving direction of the intermediate transfer member 17. The secondary transfer unit 14S employs a so-called contact transfer method and includes a secondary transfer roller 141S for forming a secondary transfer region by pressing against a back-up roller 17*d* through the intermediate transfer member 17, and a transfer voltage supplying device (not shown) connected to the secondary transfer roller 141S. The transfer voltage supplying device supplies a transfer voltage to the secondary transfer roller 141S to secondarily transfer the color toner image formed on the intermediate transfer member 17 onto a fed recording medium P. Here, the toner image forming units 30Y; 30M, 30C and 30K, the intermediate transfer member 17 and the secondary transfer unit 14S constitute a color toner image forming unit.

There is provided an intermediate transfer member cleaning unit 18S with a cleaning blade for removing the residual toner on the intermediate transfer member 17 at a downstream side position from the secondary transfer unit 14S in the moving direction of the intermediate transfer member 17.

The photoreceptors 10Y, 10M, 10C and 10K, and the intermediate transfer member 17 are operated in the direction indicated by arrows; yellow, magenta, cyan and black toner images are formed on the photoreceptors 10Y, 10M, 10C and 10K, respectively; these images are primarily transferred onto the intermediate transfer member, thus a multi-color toner image is formed on the intermediate transfer member 17 by superimposing the single color toner images. The multi-color toner image on the intermediate transfer member is transferred onto the recording medium P by the secondary transfer.

In this color image forming apparatus, image forming operations are performed as in the following. The apparatus rotatably driving the photoreceptors 10Y, 10M, 10C and 10K in the respective toner image forming units 30M, 30C and 30K; charging the photoreceptors 10Y, 10M, 10C and 10K to a predetermined polarity, for example, to negative polarity by charging devices 11*y*, 11M, 11C and 11K, respectively; exposing image forming areas to be formed toner images on the surfaces of the photoreceptors by charging devices 12Y, 12M, 12C and 12K to lower the potentials of irradiated positions (exposure areas) so that electrostatic latent images can be formed on the respective photoreceptors 10Y, 10M, 10C and 10K corresponding to an original image; and reverse-developing the latent images by adhering toners to the electrostatic latent images on the photoreceptors 10Y, 10M, 10C and 10K, the toner charged to the same polarity, for example, negative polarity as of the surface potentials of the photoreceptors 10Y, 10M, 10C and 10K. Thus, each color toner image is formed.

Further, the primary transfer unit 14Y, 14M, 14C and 14K supply the primary transfer current in respective primary transfer regions of the toner image forming units 30Y, 30M, 30C and 30K so that respective single-color toner images are primarily transferred sequentially and superimposed to form a color toner image on the intermediate transfer member 17.

The color toner image on the intermediate transfer member 17 is transferred onto the recording medium P by the secondary transfer unit 14S, and the transferred color toner image is then fixed by the fixing device 19.

In the embodiment, fog detection by a fog-detection unit to detect fog of the image and forcible toner discharge by the forcible discharge unit based on the fog detection are performed in each of the toner image forming units 30Y, 30M, 30C and 30K, but the fog detection and the forcible toner discharge will be explained exemplifying the toner image forming unit 30Y.

In a fog-detection step, a fog margin in the developing unit 13Y is set narrower, and fogging toner is adhered to the photoreceptor 10Y by charging and developing while the photoreceptor 10Y is rotatably driven in a clockwise direction.

The fog on the photoreceptor 10Y is transferred onto the intermediate transfer member 17 serving as a transfer member by the primary transfer roller 141Y. Fog density on the intermediate transfer member 17 is detected by an image density sensor GS.

In a toner forcible-discharge step, not only the charging device 11Y is driven, but also the exposing device 12Y is driven corresponding to the detected fog density to form an electrostatic latent image of a forcible-discharge image on the photoreceptor 10Y, and then development by the developing unit 13Y forms an image of the forcible-discharge image on the photoreceptor 10Y. This development permits the toner to be discharged from the developing unit 13Y. A toner supplying device 43Y serving as a toner supplying unit replenishes a toner by the discharged quantity.

In also the above-described Embodiment 2 relating to a color image forming apparatus, the function and advantageous effects similar to that of Embodiment 1 can be obtained.

EXAMPLE

Running test was performed by printing out 50,000 sheets using images having a printing rate of 0.001%, 0.1%, 1% and 10%, and photographic fog, roughness in halftone area and toner scattering are evaluated.

Image forming conditions are as follows.

Developing bias: DC −500 V+AC 1 kVp-p (frequency 5 kHz)

Developing space: 0.3 mm

The ratio of the peripheral speed of the developing sleeve to the peripheral speed of the photoreceptor: 2

Developer conveyance quantity: 200-240 g/m$^2$

Example

Forcible exchange of toner was performed based on an area ratio of a forcible-discharge image versus a fog-detection output, which is shown in Table 1.

Fog was detected by setting the fog margin V0-Vd to −50 V in the fog-detection step, while it was −150 V in the ordinary image forming step.

Comparison Example 1

Forcible exchange of toner was performed uniformly in a printing rate of less than 1%, and forcible exchange of toner was not performed in a printing rate of 1% or more.

Comparison Example 2

Forcible exchange of toner was not performed.

As a result of Example, in all environment including NN environment (20° C., 50% in relative humidity), HH environment (30° C., 80% in relative humidity) and LL environment (10° C., 20% in relative humidity), every evaluation item of fog, roughness in halftone area and toner scattering was satisfactory in printing 5,000 sheets, 10,000 sheets and 50,000 sheets.

As a result of Comparison example 1, defects in photographic fog and toner scattering occurred after printing of 10,000 sheets in the HH environment, as shown in Table 2.

TABLE 2

| | HH(30° C. 80%) | | | | NN(20° C./50%) | | | | LL(10° C./20%) | | | |
|---|---|---|---|---|---|---|---|---|---|---|---|---|
| | 0.001 | 0.1 | 1 | 10 | 0.001 | 0.1 | 1 | 10 | 0.001 | 0.1 | 1 | 10 |
| Roughness at Half-Tone area | | | | | | | | | | | | |
| 5000 | ○ | ○ | ○ | ○ | ○ | ○ | ○ | ○ | ○ | ○ | ○ | ○ |
| 10000 | ○ | ○ | ○ | ○ | ○ | ○ | ○ | ○ | ○ | ○ | ○ | ○ |
| 50000 | ○ | ○ | ○ | ○ | ○ | ○ | ○ | ○ | ○ | ○ | ○ | ○ |
| Fogging | | | | | | | | | | | | |
| 5000 | ○ | ○ | ○ | ○ | ○ | ○ | ○ | ○ | ○ | ○ | ○ | ○ |
| 10000 | Δ | ○ | ○ | ○ | ○ | ○ | ○ | ○ | ○ | ○ | ○ | ○ |
| 50000 | X | Δ | ○ | ○ | ○ | ○ | ○ | ○ | ○ | ○ | ○ | ○ |
| Toner Scattering | | | | | | | | | | | | |
| 5000 | ○ | ○ | ○ | ○ | ○ | ○ | ○ | ○ | ○ | ○ | ○ | ○ |
| 10000 | Δ | ○ | ○ | ○ | ○ | ○ | ○ | ○ | ○ | ○ | ○ | ○ |
| 50000 | X | Δ | ○ | ○ | ○ | ○ | ○ | ○ | ○ | ○ | ○ | ○ |

In Table 2, ○, Δ, x indicate Good state, Medium state and No good state, in image quality, respectively.

As a result of Comparison example 2, defects of image quality occurred in all evaluation items in the NN environment, as shown in Table 3.

TABLE 3

| | 0.001 | 0.1 | 1 | 10 |
|---|---|---|---|---|
| Roughness at Half-Tone area | | | | |
| 5000 | X | X | Δ | ○ |
| 10000 | X | X | X | ○ |
| 50000 | X | X | X | ○ |
| Fogging | | | | |
| 5000 | X | Δ | ○ | ○ |
| 10000 | X | X | Δ | ○ |
| 50000 | X | X | X | ○ |
| Toner Scattering | | | | |
| 5000 | ○ | ○ | ○ | ○ |
| 10000 | Δ | ○ | ○ | ○ |
| 50000 | X | X | Δ | ○ |

In Table 3, ○, Δ, x indicate Good state, Medium state and No good state, in image quality, respectively.

Here, the result of Example was satisfactory in all evaluation items corresponding to Table 2, and therefore presentation of the evaluation result using a table is omitted. In Comparison example 2, defects of image quality occurred even in the NN environment that is a good condition, and therefore presentation of results in the LL environment and the HH environment, which are worse conditions, is omitted.

While the present invention has been described in connection with the preferred embodiment thereof, it should be understood that it is not limited to the above-described embodiments, that is, the invention may include various kinds of improvements, revisions and the like, which fall within the spirit and scope of the invention.

What is claimed is:

1. An image forming apparatus comprising:

an image carrying member;

a latent image forming unit to form an electrostatic latent image on the image carrying member;

a developing unit to form a toner image by developing the electrostatic latent image on the image carrying member;

a forcible discharge unit to forcibly discharge the toner from the developing unit;

a toner supplying unit to supply toner after the forcibly discharging; and a fog-detection unit to detect fog of the image, wherein the forcible discharge unit forcibly discharges the toner from the developing unit based on a detected result of the fog-detection unit.

2. The image forming apparatus of claim 1, wherein the fog-detection unit comprises an image density sensor to detect the fog of the image formed on the image carrying member or on a transfer member.

3. The image forming apparatus of claim 1, comprising a condition control unit to control image forming conditions, and having an image quality adjustment mode for controlling the forcible discharge of toner based on the detected result of the fog of the image, wherein the condition control unit sets an image forming condition for occurrence of fog in the image quality adjustment mode.

4. The image forming apparatus of claim 1, wherein the forcible discharge unit forcibly discharges the toner by a quantity corresponding to a fog level detected by the fog-detection unit.

5. The image forming apparatus of claim 1, comprising a humidity sensor to detect environmental humidity, and a density control unit to control toner density in a developer based on the detected result of the humidity sensor.

6. The image forming apparatus of claim 1, comprising a number-of-sheets counter to count the number of image-formed sheets, and a density control unit to control toner density in a developer based on a counted value of the number-of-sheets counter.

7. The image forming apparatus of claim 1, wherein the developing unit comprises a developer carrying member which rotates with facing the image carrying member, to develop the electrostatic latent image on the image carrying member, and the image forming apparatus comprises a power source to apply a direct-current component of a developing bias voltage to the developer carrying member.

8. The image forming apparatus of claim 7, wherein the direct-current component of the developing bias voltage is controlled so that a fog margin in the fog detection of the image is narrower than that in the image forming.

9. The image forming apparatus of claim 1, comprising an intermediate transfer member on which the toner image formed on the image carrying member is transferred.

10. The image forming apparatus of claim 9, wherein the fog detection is performed by using the toner image transferred on the intermediate transfer member.

11. The image forming apparatus of claim 1, wherein the forcible-discharge unit forms a toner image for forcible discharge on the image carrying member.

12. The image forming apparatus of claim 11, wherein the forcible-discharge unit controls forcibly discharged toner quantity by controlling an area or a density of the toner image made by the forcibly discharged toner on the image carrying member.

13. The image forming apparatus of claim 1, wherein the image forming apparatus comprises a toner density sensor to detect a toner density in the developing unit, and the toner supplying unit supplies toner based on a detected result of the toner density sensor.

14. An image adjusting method comprising:

adjusting a developing bias voltage applied on an image carrying member;

developing an image on the image carrying member by toner in a developing unit, to form a toner image;

detecting fog by using the toner image;

discharging the toner forcibly from the developing unit based on a result of fog detection; and supplying toner after the discharging the toner forcibly.

15. The image adjusting method of claim 14, wherein the image adjusting is performed at every predetermined number of sheets of image formation.

16. The image adjusting method of claim 14, wherein the image adjusting is performed at every image formation job.

17. The image adjusting method of claim 14, wherein the image adjusting is performed when an image forming apparatus is turned on.

18. The image adjusting method of claim 14, wherein the discharging the toner forcibly includes forming a toner image for forcible discharge on the image carrying member.

19. The image adjusting method of claim 14, wherein the detecting fog is performed by detecting a toner density of the toner image.

20. The image adjusting method of claim 14, wherein the supplying toner is performed based on a toner density in the developing unit.

* * * * *